US007040499B1

(12) United States Patent
Reif

(10) Patent No.: US 7,040,499 B1
(45) Date of Patent: May 9, 2006

(54) CONTAINER WITH PRIMARY CLOSURE AND A SECONDARY CLOSURE

(76) Inventor: Michael Y. Reif, 312 Calle, San Miguel, P.O. Box 156-1250, Escazu (CR)

( * ) Notice: Subject to any disclaimer, the term of this patent is extended or adjusted under 35 U.S.C. 154(b) by 0 days.

(21) Appl. No.: 10/404,433

(22) Filed: Apr. 2, 2003

(51) Int. Cl.
*B65D 41/04* (2006.01)

(52) U.S. Cl. ..... 220/291; 220/375; 220/839; 220/319; 220/327; 215/235; 215/237; 215/274; 215/276; 215/243; 222/556; 222/153.09; 222/153.14; 222/562

(58) Field of Classification Search ..... 220/291, 220/319, 327, 375, 836, 837, 839, 817, 820; 215/274, 276, 235, 237, 243, DIG. 8, 236; 222/153.04, 153.09, 556, 153.14, 562, 563, 222/554
See application file for complete search history.

(56) References Cited

U.S. PATENT DOCUMENTS

| | | | | | |
|---|---|---|---|---|---|
| RE3,781 | E | * | 12/1869 | Focer | 215/276 |
| 1,596,115 | A | * | 8/1926 | Pardee | 220/291 |
| 2,287,625 | A | * | 6/1942 | Leach | 220/291 |
| 2,736,333 | A | * | 2/1956 | Hancox | 220/291 |
| 3,110,410 | A | * | 11/1963 | Pehr | 215/243 |
| 4,033,472 | A | * | 7/1977 | Aichinger | 215/256 |
| 4,336,891 | A | * | 6/1982 | Smith | 215/276 |
| 4,722,449 | A | * | 2/1988 | Dubach | 215/235 |
| 4,749,821 | A | * | 6/1988 | Linton et al. | 174/35 R |
| 5,078,289 | A | * | 1/1992 | Bolton et al. | 215/228 |

* cited by examiner

*Primary Examiner*—Robin A. Hylton
(74) *Attorney, Agent, or Firm*—Dowell & Dowell, P.C.

(57) ABSTRACT

Capped containers for use on a residence counter have caps which swingably connect the cap to the container for closure. If the contents of the container is a thin or watery liquid the ordinary closure may not prevent leakage during vibration, travelling or pressure. There is here provided a container with an additional closure formed when a sleeve is arranged to move to an extended position and then to thread to both the cap and the container to provide a fluid tight connection to each.

3 Claims, 6 Drawing Sheets

CONTAINER WITH PRIMARY CLOSURE AND A SECONDARY CLOSURE

FIELD OF THE INVENTION

This invention relates to containers having caps. Such containers have caps swingably connecting the cap to the container and usually provide a design wherein the cap may through said swingable connection be moved relative to the container between an open position and a closure position relative to a dispensing opening.

BACKGROUND OF THE INVENTION

A dispensing opening in the container when the cap is open allows the withdrawal or dispensing of materials from the container. Over the range of containers the materials may vary from very viscous material such as toothpaste or thick oil to very watery materials such as suntan oils, baby lotion, etc. Cap closure means is usually adequate to prevent the escape of such contents as viscous lotions or thick oil but frequently will allow some leakage of very thin or watery substances such as suntan and baby oils, contact lens solution, etc. particularly if the container is under pressure, vibrated or inverted.

Typically the dispensing opening is defined by a spout being an upwardly directed outlet from the container upper surface in the usual attitude of the container for frequent use on a counter in a dwelling or residence.

Thus the container of the thin liquid is provided with a cap movable to leave the dispensing opening open or in closure position and is very convenient to use while standing on a counter or at home while being subject to the risk of leakage due to changing orientation or pressures during travel.

For thin liquids this invention provides a container having two closures, the first of which is a cap closure used when the container is in frequent use, e.g. on a counter in a residence or dwelling. The cap closure usually involves the dispensing opening and a plug therefor.

The term 'container' herein frequently includes a container top threaded to the container body, the threaded connection being then unconnected with the other threading described herein.

SUMMARY OF THE INVENTION

In accord with the invention a second closure is provided for the container during travel or other action when the container may be inverted, on its side or vibrated. The second closure utilizes a threaded sleeve which in a retracted position is threaded to one of the cap or the container. The other of the cap or the container is also provided with threading designed to form a continuation of the threading on the one of the cap or container members when the cap is placed in closure position.

Thus when the container is to be taken travelling, the cap is first placed in closure position unless it was in the closure position already, then the sleeve is rotated from its retracted position on threading of one of the container or cap. The sleeve is then rotated on its container or cap to thread onto the other of the container or cap and thus the boundary between the container and cap is closed by the threaded joints between cap and sleeve and container and sleeve.

The type of cap closure may vary so long as it provides a near closure when the container is on a counter and so long as it allows provision of the second closure with the sleeve threaded to each of the container and cap.

The invention may be designed to operate with the customary orientation of the container in the residence or dwelling whichever this may be. For example a container with which the invention is used may be shaped to be upright with the cap at the top, may be designed to be laid on the side, and some may be designed to be kept in or may be designed to stand on the cap, the last referred to as a "stand on cap design".

A BRIEF DESCRIPTION OF THE DRAWINGS

In drawings which illustrate preferred embodiments of the invention:

DETAILED DESCRIPTION OF THE INVENTION

Figure 1A:
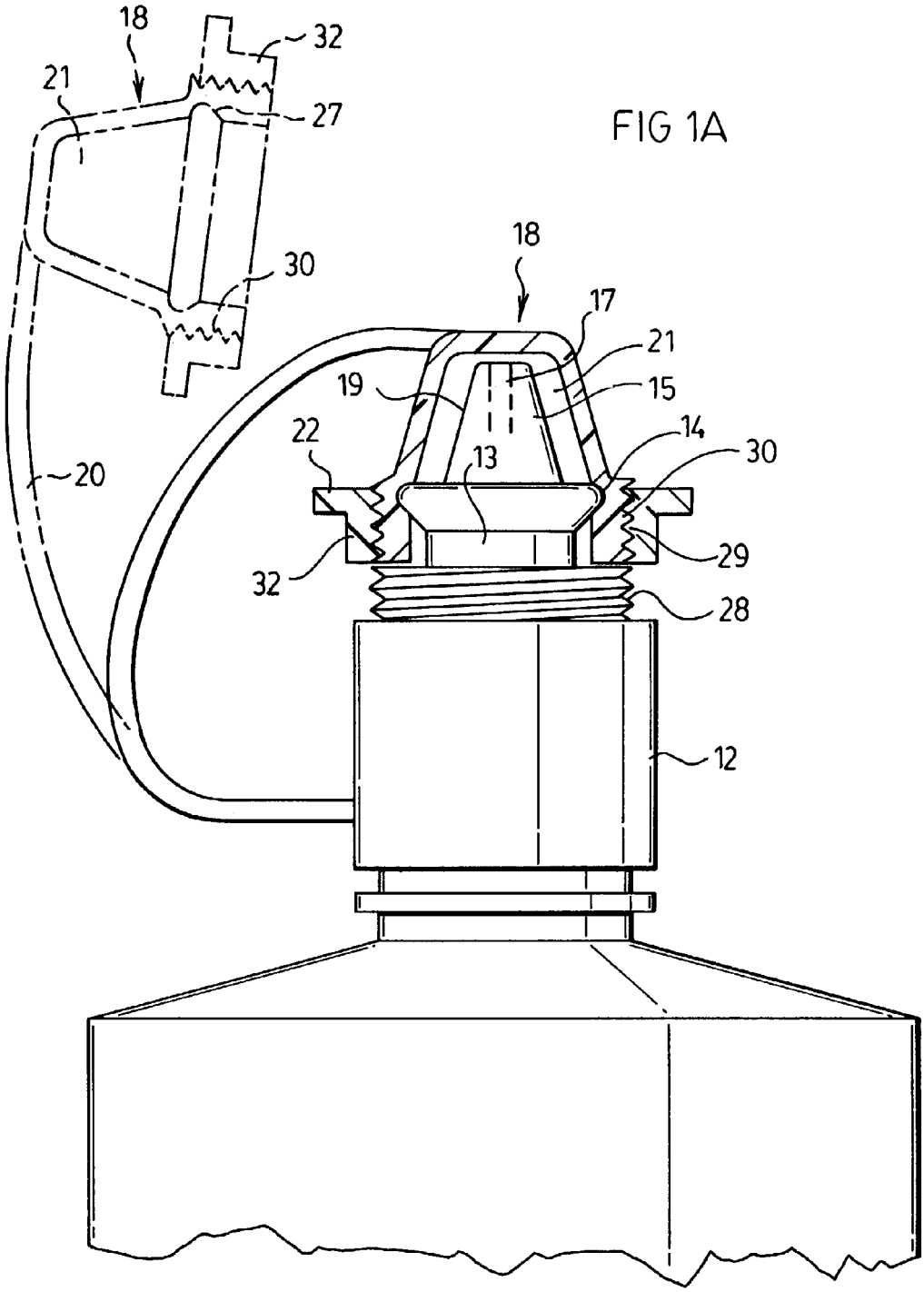
FIG. 1A shows a first embodiment of the invention with the sleeve retracted and the cap in closure position and in open position.
Figure 1B:
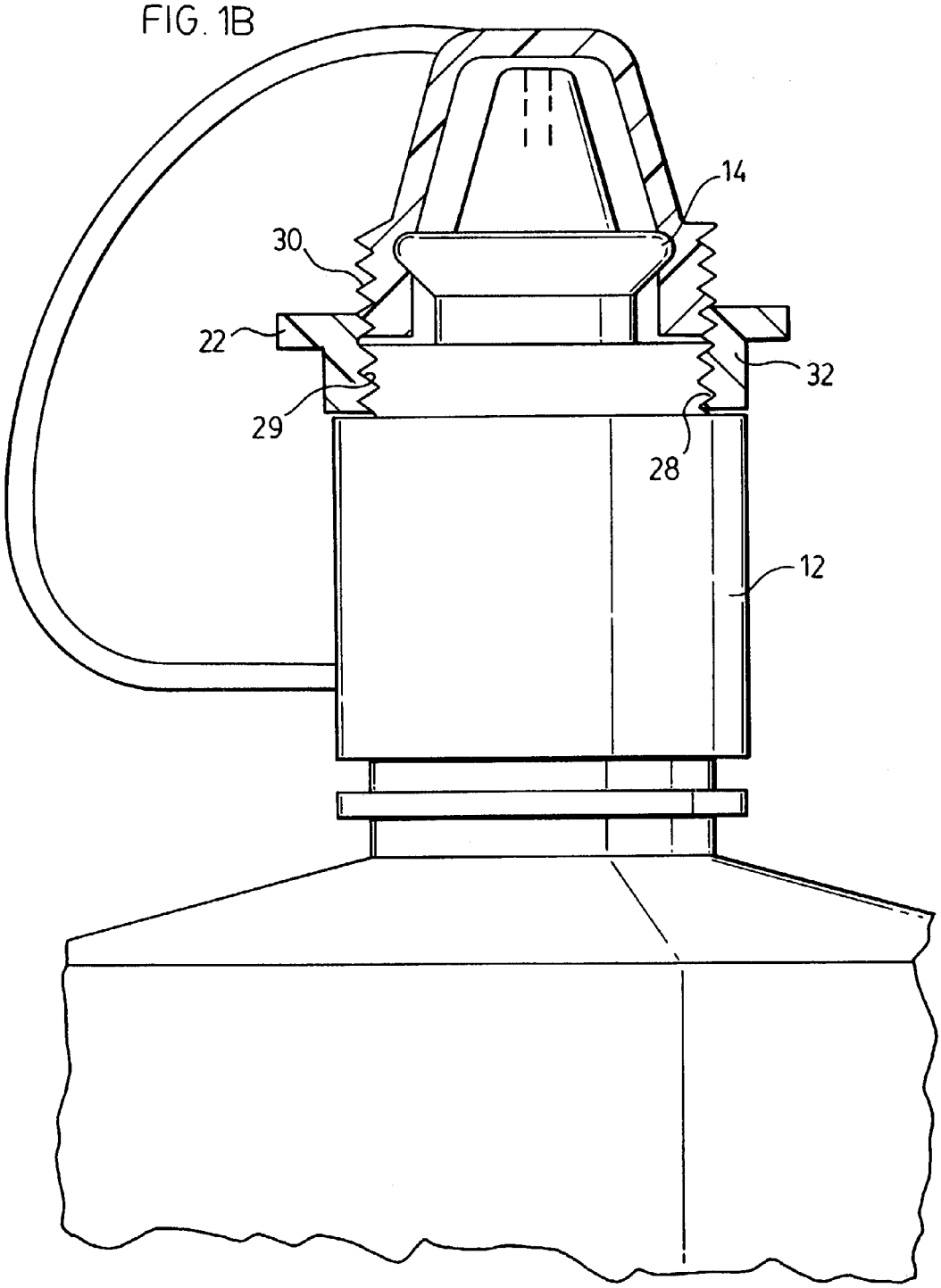
FIG. 1B shows the first embodiment with the cap in closure position and the sleeve in extended position.

In the embodiment of FIGS. 1A, 1B, a container usually has a top portion 12 which may be screwed on and off the remainder of the container. This threading (not shown) is not related to the inventive threading but such upper attachment is also shown in FIG. 3B. On the top surface of the container is a spout 15. The spout often comprises an upraised neck with an outwardly directed rim 14, which is usually a circle in plan view.

Above the rim 14, the spout tapers upwardly at 19 to define a dispensing opening 17 through which liquid may be released, by shaking, tipping, etc.

The spout 15 is provided with outwardly directed threading 28 below the convexity 25 in rim 14 and the top of upper portion 12. The threading faces outwardly and is helical about the circular spout, and is located outwardly far enough beyond the rim 14 that it may receive the complementary threads of a sleeve, to be described, without interference between rim and sleeve.

A cap 18 for the spout is part of and movable on the resilient tether 20 from open position clear of the spout 15 dotted position in FIG. 1A to a closure position, solid position in FIG. 1A, where, as is to be described, it closes the space about the dispensing opening to a large degree against escape of liquid.

The cap is shaped to define an inwardly facing concavity 21 to receive the tapering portion 19 of the spout. The inwardly facing circular area on the cap which is located to contact the rim 14 when the cap moves to closure position is shaped at 27 to be concave toward the rim so that it may couple to the convexity 25 by a snap action to hold the cap in closure position and form a partial closure, although not necessarily a full closure for a thin liquid.

The cap 18 is provided with threading 30 of the same dimensions and pitch as threading 28.

As shown in FIGS. 1B, the threading 30 is located to act as an extension of threading 28 in the closure position of the cap. The dimensions and pitch of the threadings 28 and 30 thus correspond.

Threadedly mounted by its threading 29 on the cap threading 30 there is a sleeve 32 preferably of a length sufficient to cover the cap threads when the sleeve is retracted. The sleeve may be provided with an outwardly projecting rim 22 which may be knurled or shaped to assist digital manipulation.

When the cap is held by rim 14 and concavity 27 in closure position, the sleeve 32 may be digitally rotated to couple its threading 29 to container threading 28. It will be noted that such coupling will take place even if there is a slight gap between cap and container threads 30 and 28 and any slight misalignment will tend to correct itself as the sleeve 32 is screwed down on the container threading 28. Moreover, it will be noted that even with such small gap or slight misalignment the closure of the space inside the cap, to prevent escape of liquid from the container to the outside, is formed by threaded junction threading 29 and 28 at the container and by threading 29 and 30 at the cap.

Thus in accord with the invention, to use the liquid in the container sleeve, in retracted position as shown in FIG. 1A (dotted and solid), the cap 18 is retracted to open position as shown in FIG. 1A dotted position, and the liquid may then be dispensed from the container by shaking, squeezing or pouring depending on the contents. When not in use, in a residence or dwelling, the cap is preferably snapped shut as in FIG. 1A solid line position with rim 14 held by concavity 27. When the container is to be taken travelling, the container is placed in FIG. 1A solid position. The sleeve 32 is then rotated to thread its threading 29 on to threading 28. The container is then in condition to travel substantially closed by the threaded junction of sleeve 29 and cap 30 threading and by the threaded junction of sleeve 29 and container 28 threading.

(It should be clearly understood that another releasable closure or snap closure is permissable. The requirement then is that whatever initial closure is used, it must allow the releasable completion of the threaded coupling.) When the container of FIGS. 1A and 1B has been closed for travel and it is desired to use it at the destination location then it is necessary to rotate sleeve 32 to retracted position so that the threads 29 no longer connect to container threads 28 and the container may be used on a counter with the cap open and/or closed.

Figure 2A:
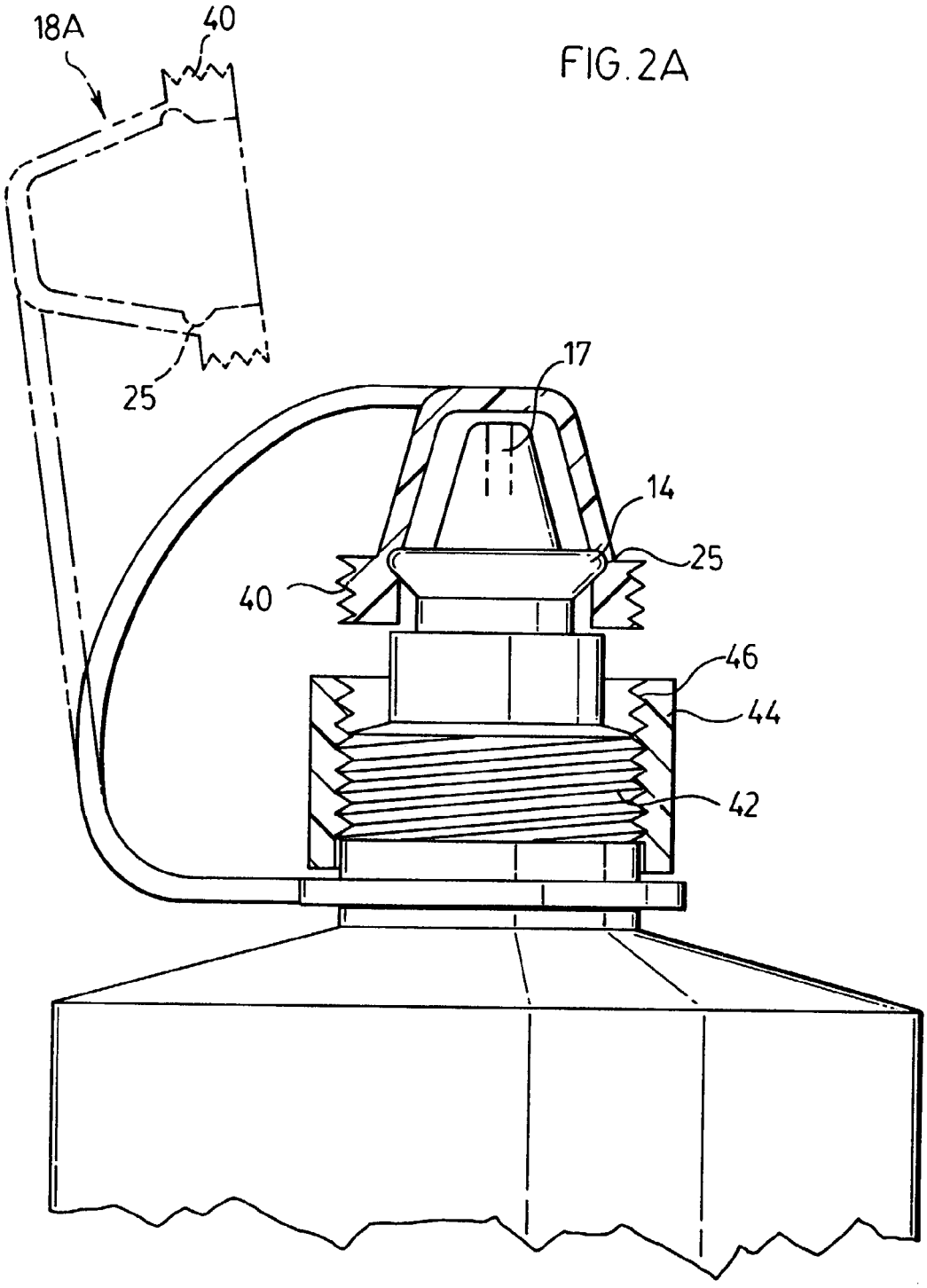
FIG. 2A shows a second embodiment of the invention with the sleeve retracted and the cap in closure and in open position.
Figure 2B:
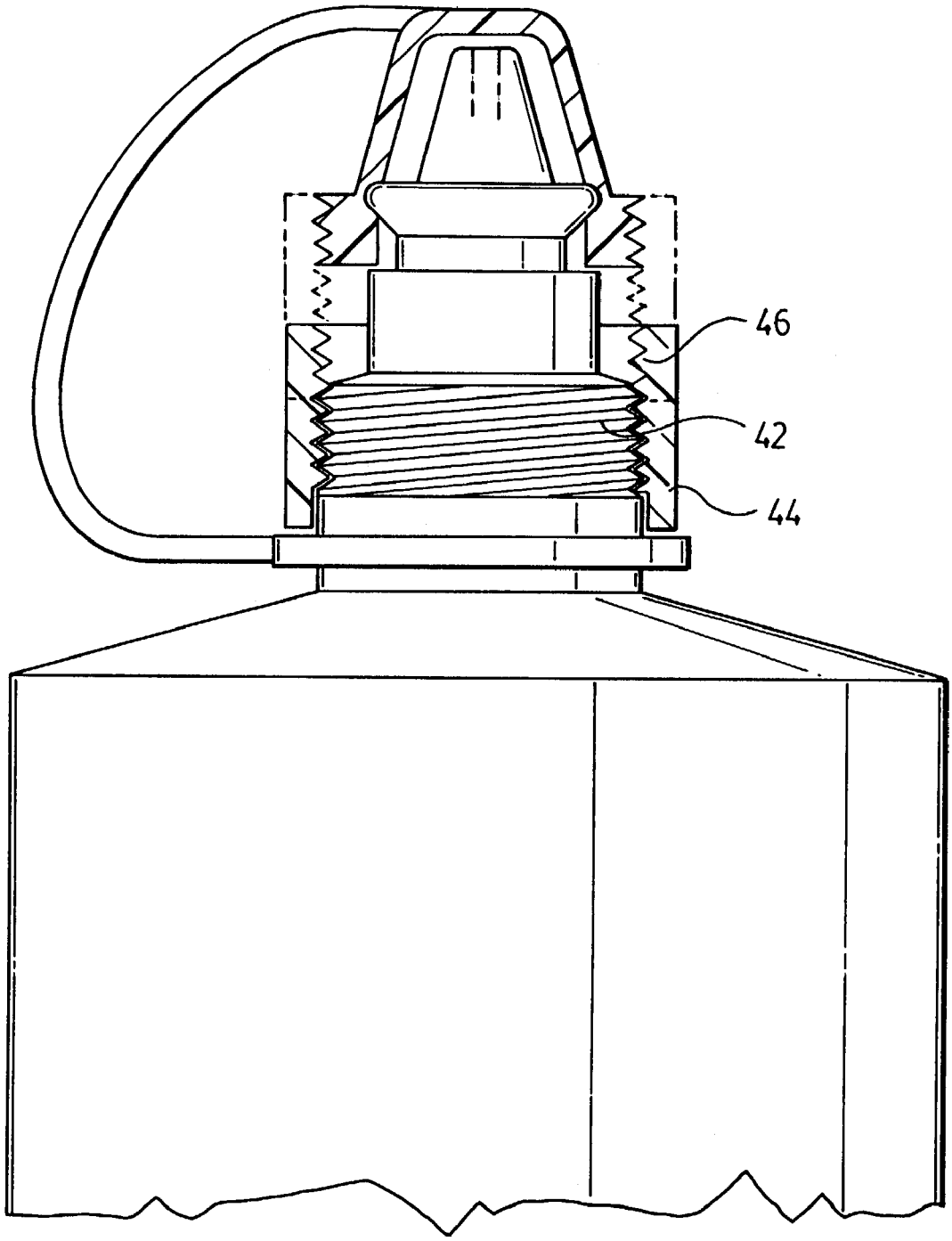
FIG. 2B shows the second embodiment with the cap in closure position and the sleeve in retracted and extended position.

In the second embodiment of FIGS. 2A and 2B the tether 20 and the snap closure between rim 25 and concavity 27 may be the same as illustrated FIGS. 1A and 1B.

With the second embodiment the cap 18A may be open in the dotted position of FIG. 2A and the material in the container may be dispensed from the spout through opening 17 as with the container of FIG. 1A.

To close the container for residential or dwelling use, it is snapped closed at members 27 and 25 as with the previous embodiment and the closed snap closure is shown at FIG. 2A solid line.

In FIGS. 2A, 2B, the upper portion of the container is outwardly threaded at 42 to threadedly mount a sleeve 44 at sleeve threading 46. The sleeve 44 may then be rotated upward until the threads make threaded junction with threading 40 of same depth and pitch on cap 18A.

To close the container for travel with the cap 18A already in closure position, the sleeve 44 is threadedly rotated until threading 46 engages threading 40 on the cap 18A. With the sleeve thus extended the escape of liquid is closed off by meshed threads 46–42 at the sleeve container junction and 46–40 at the sleeve cap junction. When the container of FIGS. 2A and 2B has been closed for travel and it is desired to use it at the destination location then it is necessary to rotate sleeve 46 to its retracted (solid line position in FIG. 2B) after which the container may be used at its new location with cap 18A closed or open as desired.

The material used for the container cap and sleeve will be any mouldable plastic thought suitable for use.

Figure 3A:
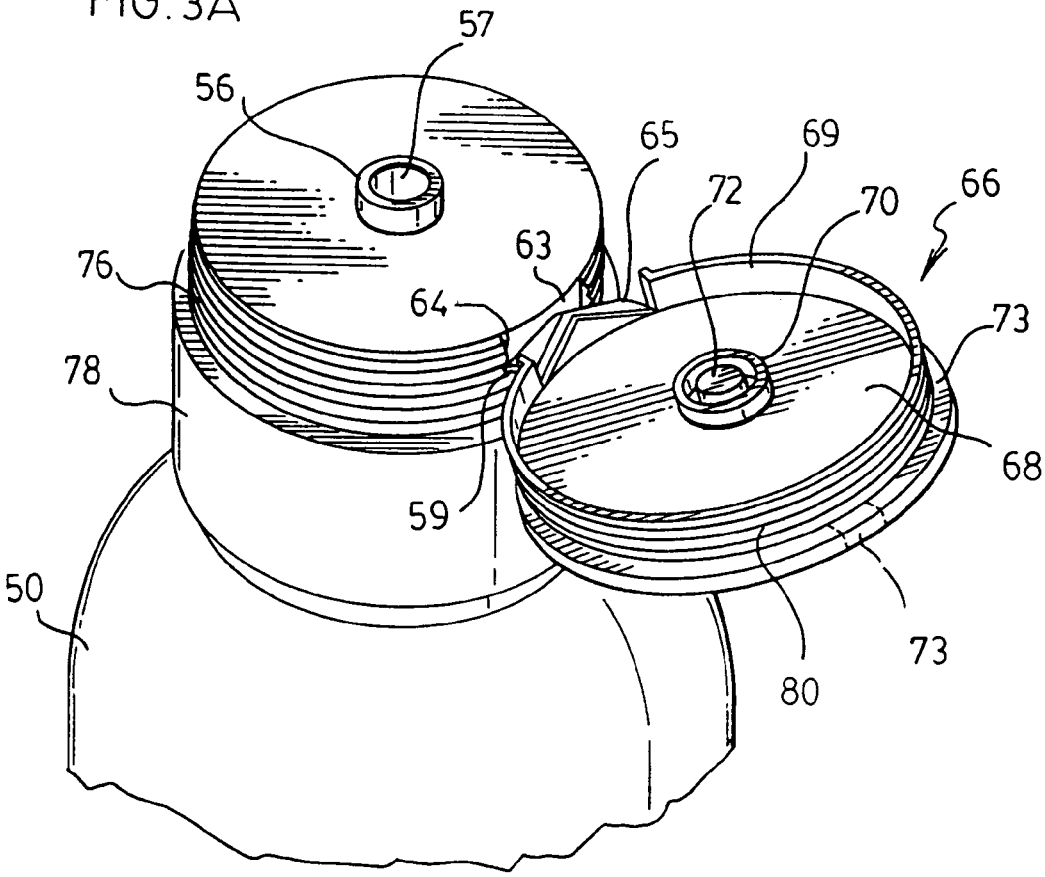
FIG. 3A is a perspective of a third embodiment with the cap open and the sleeve retracted.
Figure 3C:
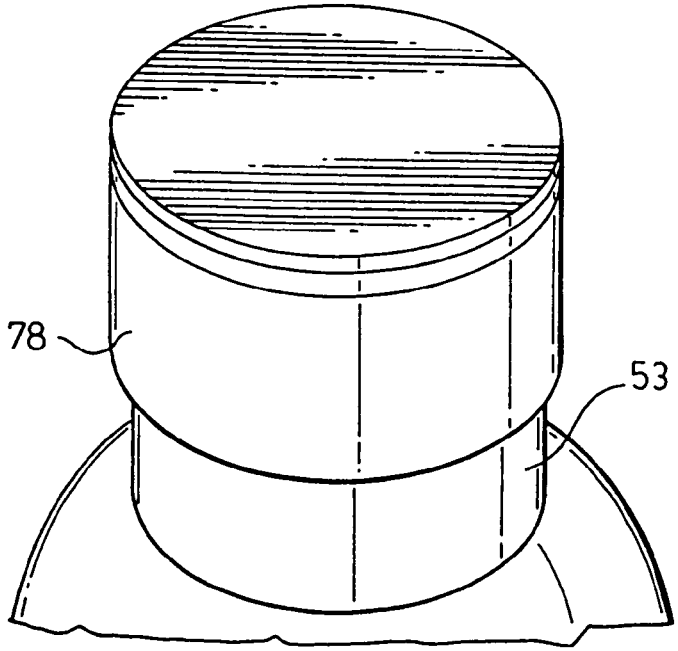
FIG. 3C is a perspective of the bottle closed by threaded sleeve.
Figure 3B:
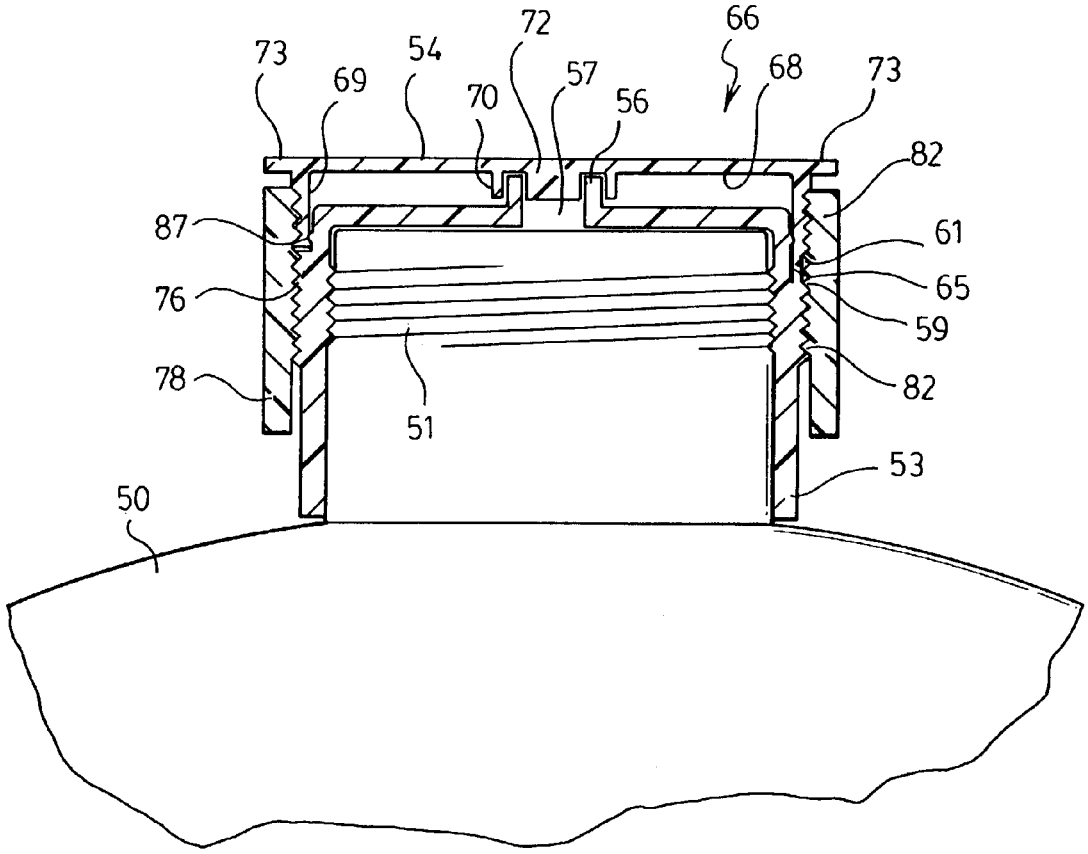
FIG. 3B is a vertical section of the device of FIG. 3A with the cap in closure position and the sleeve in extended position.

The third embodiment of the invention is shown in FIGS. 3A, 3B and 3C. FIG. 3B shows that the upper end of the container 50 threadably mounts on (threads 51) container top member 53. (The threading 51 is not part of the sleeve and container cap threading forming part of the invention.) The term container herein includes top member 53. Container 50 is assumed to be for watery liquids such as described. In FIGS. 3A, 3B, 3C, container 50 has an outward threading 76 terminating below upper surface 54 having a cylindrical spout 56 having a central dispensing opening 57 to allow dispensing of material from the container.

A hinge 65 has its lower end attached at 59 to the container intermediate the upper and lower limits of threading 76. The threading 76 between the hinge attachment 59 and top of hinge 65 is removed at 61 and the surface 63, below the then closed position of hinge, is recessed so that the outer surface of the hinge 65 may be inward of the sleeve 78 threading 82 in the closed position of the cap.

The upper surface or cap base 54 is at the top of the cap 66,s shown in FIG. 3B.

Cap 66 has surface 68 upwardly facing in FIG. 3A and downwardly facing in FIG. 3B. A downwardly depending edge 69 from surface 68 is designed to snap onto band 64 above the container threading 76 to form a snap closure. Band 64 is cut away at 63 to allow the hinge to rest in closed position with the hinge 65 sufficiently radially inward so that it is not contacted by the sleeve threads 82 in the extended position of the sleeve. A cylindrical wall 70 projecting from surface 68 fits relatively snuggly about the spout 56 in the closure cap position. At the same time cylindrical plug 72 snuggly fits in spout 56 in the closure cap position.

In closure position the spout 56 is snuggly surrounded by wall 70 and is snuggly filled by plug 72. The cap 66 is preferably provided with an outwardly extending brim 73 which extends outwardly about as far as sleeve 78. The brim 73 allows easy digital manipulation of the cap with sleeve 78 retracted. Digital manipulation may also be achieved without a full brim, with a projection from band 64 opposed to the hinge location as at 73* in dotted outline. The closure with the snap action of edge 69 and band 64 is relatively secure if materials in the container 50 are relatively viscous. However watery substances such as previously described may leak through the closure. Thus to the snap closure referred to above is added the sleeve closure to be described. The principle of the snap closure is well known and the parts here used are schematically shown at 87. Alternate snap closures may be used which do not interfere with the thread operation.

The container 50 has a cylindrical top member 53. The exterior of top 53 is threaded at 76 to threadedly receive sleeve 78 through the latter's threading 82. The threading 76 is interrupted at 63 and the surface of the container is there recessed beyond the roots of the threads 76 so that, in the closure position of the cap 66, the hinge 65 is received in the recess and does not interfere with the sleeve threads 82 when they are rotated. The edge 64 is also interrupted at 63 to allow the presence of hinge 65.

Moreover the surface at 63 is of sufficiently limited diameter as to allow the sleeve threads 82 to uninterruptedly contact the cap threads 80 to be described.

On the cap the side walls are provided with thread 80 adapted to make thread meshing junction with the sleeve threads 82 on rotating of the latter when the cap is in closure position.

The band 64 is limited to a diameter inwardly of the threads 76 so that the band 64 will not interfere with the sleeve threads 82 when they are engaged with threads 80 or moving into or out of contact therewith.

The cap 66 may be manipulated digitally with sleeve 78 retracted as in FIG. 3A.

The embodiment of FIGS. 3A, 3B and 3C operates in accord with the principles of the invention for use with watery substances such as previously referred to.

In accord with the invention the embodiment has an open state shown in FIG. 3A with sleeve 78 retracted on threading 76 and edge 69 is free of band 64. Thus the container may be used by the owner, so that the cap is open to allow the dispensing of liquid from spout 56 at will.

When it is desired to close the container but keep it ready for future use on a residence counter, the cap 66 is moved to closure position in the position of FIG. 3B with edge 69 snapped about band 64 and the sleeve 78 remains in its retracted position on threading 76 as shown in FIG. 3A.

When it is decided to seal the container for travel, the cap 66 is first snapped to a closure position (edge 60 on band 64). Then the sleeve 78 is manually rotated from its position of FIG. 3A to move the sleeve 78 upwardly on container threading 76 until the sleeve threads 82 pass the end of the container threads 76 and continue until they contact cap threads 80. With further rotation to the position of FIG. 3B sleeve threads 82 then continue further upwardly to make a threaded connection with threading 80.

With an extent of meshing of sleeve threads 82 and cap threads 80 a second closure for the container is achieved. The sleeve is threadedly sealed to the container by the threaded contact of threads 76 and 82 below hinge 65 and below the location of thread removal, and recessing. The sleeve is also threadedly sealed by cap threads 80 meshed with sleeve threads 82 at a location upward of hinge 65 and above the location 63 of thread removal and recessing.

Thus the two threaded connections 76–82 and 80–82 seal the container against the escape of liquid.

It is within the scope of the invention to use a container and hinge type of FIGS. 3A, 3B and 3C where the cap will threadedly carry the sleeve in the sleeve's retracted position so that with the cap closed the sleeve may be moved to an extended position, threading onto threads on the container top (like 53) to complete the threaded closure.

The invention may be made with any suitable plastic known to those skilled in the art. Such plastics include polyethylene, polypropylene and polystyrene For hinge 65 I prefer to use hinges commonly in use. However any hinge which will allow pivoting of the cap between open and closure positions and non-interference with the sleeve threading when moved to extended position, may be used within the scope of the invention.

This invention extends to devices where the cap closure is or is not a snap closure.

I claim:

1. A dispensing container including a dispenser having a dispensing opening and external threading, a cap pivotally connected by a unitary hinge to said container, said cap having external threading and being movable between an open position and a closure position and including a plug, whereby, in said closure position of said cap, said plug seats within said dispensing opening and closes said dispensing opening, a sleeve having internal threading, said sleeve internal threading, when said cap is in said closure position thereof, being selectively engaged at the same time with said external threading of said cap and said external threading of said container to thereby securely lock said cap in said closure position relative to said dispensing opening, said internal threading of said sleeve intermeshing with said external threading of only one of said cap and said container when said cap is in said open position thereof, and said cap including a depending edge portion above the external threads of said container for snap fitting with a portion of said container.

2. A dispensing container having a body with a dispensing opening, a cap pivotally connected by a unitary hinge to said container so that said cap is movable between an open position and a closure position, and in said closure position closes said dispensing opening, said container having external threading surrounding said dispensing opening, said cap having external threading, said container external threading and said cap external threading having the same pitch and size, a sleeve having internal threading which, when said cap is in said open position, is engaged in a first position thereof with only said external threading of one of said cap and said container such that said cap remains movable between said open and closure positions thereof, said sleeve internal threading, when said cap is in said closure position, may be intermeshed at the same times in a second position thereof, with said external threading of said container and said external threading of said cap to thereby lock said cap in the position of closure with respect to said dispensing opening, said sleeve surrounding said hinge in the second position thereof, and, in said closure position of said cap, said hinge is located in a recess in said external threading of said container.

3. A dispensing container having a body with a dispensing opening, a cap pivotally connected by a unitary hinge to said container so that said cap is movable between an open position and a closure position, and in said closure position closes said dispensing opening, said container having external threading surrounding said dispensing opening, said cap having external threading, said container external threading and said cap external threading having the same pitch and size, a sleeve having internal threading which, when said cap is in said open position, is engaged in a first position thereof with only said external threading of said container such that said cap remains movable between said open and closure positions thereof, and said sleeve internal threading, when said cap is in said closure position, may be intermeshed at the same time, in a second position thereof with said external threading of said container and said external threading of said cap to thereby lock said cap in the position of closure with respect to said dispensing opening.

* * * * *